US009845964B2

(12) United States Patent
Lee et al.

(10) Patent No.: US 9,845,964 B2
(45) Date of Patent: Dec. 19, 2017

(54) AIR CONDITIONER HAVING HUMAN BODY SENSING ANTENNA UNIT

(71) Applicant: LG Electronics Inc., Seoul (KR)

(72) Inventors: Joongkeun Lee, Seoul (KR); Kunkook Park, Seoul (KR); Juwan Lee, Seoul (KR); Daegeun Seo, Seoul (KR); Soonhaeng Jo, Seoul (KR)

(73) Assignee: LG Electronics Inc., Seoul (KR)

( * ) Notice: Subject to any disclaimer, the term of this patent is extended or adjusted under 35 U.S.C. 154(b) by 628 days.

(21) Appl. No.: 14/307,676

(22) Filed: Jun. 18, 2014

(65) Prior Publication Data

US 2014/0374083 A1 Dec. 25, 2014

(30) Foreign Application Priority Data

Jun. 19, 2013 (KR) ..... 10-2013-0070275

(51) Int. Cl.
*F24F 11/00* (2006.01)

(52) U.S. Cl.
CPC ..... *F24F 11/0034* (2013.01); *F24F 11/006* (2013.01); *F24F 2011/0035* (2013.01); *F24F 2011/0036* (2013.01); *F24F 2011/0068* (2013.01)

(58) Field of Classification Search
CPC ..... F24F 11/0034; F24F 2011/0035; F24F 2011/0036
USPC ..... 250/342; 700/277; 342/27, 28; 165/237
See application file for complete search history.

(56) References Cited

U.S. PATENT DOCUMENTS 5,097,672 A * 3/1992 Takenaka ..... F24F 1/00 165/237
5,107,120 A * 4/1992 Tom ..... G01J 5/34 250/338.3
5,165,465 A * 11/1992 Kenet ..... G08B 19/005 165/11.1
5,218,345 A * 6/1993 Muller ..... G08B 13/193 250/338.1
5,283,551 A * 2/1994 Guscott ..... G08B 13/19 250/332

(Continued)

FOREIGN PATENT DOCUMENTS

CN 101639270 2/2010
CN 101737907 6/2010

(Continued)

OTHER PUBLICATIONS

Chang et al., An Algorithm for UWB Radar-Based Human Detection, IEEE, 2009.*

(Continued)

*Primary Examiner* — Devon Russell
(74) *Attorney, Agent, or Firm* — Fish & Richardson P.C.

(57) ABSTRACT

Disclosed is an air conditioner. The air conditioner includes an outdoor unit. The air conditioner further includes an indoor unit located in a building and configured to distribute cool air to a space within the building. The air conditioner further includes an antenna unit configured to sense (i) movement of human bodies within the space or (ii) presence of human bodies located in the space and determine a number of human bodies based on the sensed presence, where the antenna unit includes a housing and a plurality of antenna arrays located on an outer surface of the housing.

12 Claims, 8 Drawing Sheets

(56) References Cited

U.S. PATENT DOCUMENTS 5,331,825 A * 7/1994 Kim ..... F24F 11/0034 236/51
5,442,178 A * 8/1995 Baldwin ..... G08B 13/193 250/342
5,453,618 A * 9/1995 Sutton ..... H04N 3/09 250/332
5,585,631 A * 12/1996 Deguchi ..... G08B 13/191 250/332
5,637,040 A * 6/1997 Kim ..... F24F 11/0034 165/237
5,815,078 A * 9/1998 Mun ..... F24F 11/0078 236/49.3
5,819,840 A * 10/1998 Wilson ..... G05D 23/1902 165/11.1
6,189,799 B1 * 2/2001 Parker ..... F04D 25/088 236/51
7,185,504 B2 * 3/2007 Kasai ..... F24F 1/0007 454/292
8,155,792 B2 * 4/2012 Park ..... F24F 11/0034 700/153
8,220,278 B2 * 7/2012 Han ..... F24F 11/0012 165/237
8,424,325 B2 * 4/2013 Choi ..... F24F 1/0007 165/237
8,809,789 B2 * 8/2014 Matsumoto ..... F24F 1/0007 250/353
9,255,717 B2 * 2/2016 Nam ..... F24F 1/0007
2003/0211820 A1 * 11/2003 Tsuji ..... B60H 1/00785 454/93
2009/0014657 A1 * 1/2009 Cole ..... G08B 13/19602 250/353
2009/0090125 A1 * 4/2009 Seki ..... F24F 11/0078 62/407
2009/0230307 A1 * 9/2009 Han ..... G01J 5/0022 250/342
2011/0277982 A1 * 11/2011 Kim ..... F24F 1/0007 165/237
2012/0318490 A1 * 12/2012 Kopp ..... F24F 11/0009 165/237
2013/0144563 A1 * 6/2013 Naumann ..... G01J 5/0022 702/190

FOREIGN PATENT DOCUMENTS

CN 102575862 7/2012
JP H02-075846 3/1990

OTHER PUBLICATIONS

Huang, "Performance study of through-wall imaging system based on IR-UWB," Information technology volume of China Doctoral Thesis Full-text Database, pp. 1136-114, Jul. 15, 2011, with translation.
Office Action issued in Chinese Application No. 201410254360.4 dated Jul. 20, 2016, 20 pages (with English translation).

* cited by examiner

AIR CONDITIONER HAVING HUMAN BODY SENSING ANTENNA UNIT

CROSS REFERENCE TO RELATED APPLICATION

Pursuant to 35 U.S.C. §119(a), this application claims the benefit of Korean Patent Application No. 10-2013-0070275 filed on Jun. 19, 2013, which is hereby incorporated by reference as if fully set forth herein.

FIELD

The present disclosure relates to an air conditioner, and more particularly, to an air conditioner having a human body sensing antenna unit that senses movement of human bodies or the number of human bodies located within an indoor space.

BACKGROUND

In general, an air conditioner is an apparatus which cools or heats an indoor space by performing a process of compressing, condensing, expanding, and evaporating a refrigerant.

Recently, as energy saving measures to address global warming have been implemented, various methods for effective energy consumption of conventional energy consumption apparatuses have been proposed.

As to such energy saving, methods of controlling air conditioners in which the number of human bodies or movement of human bodies located within an indoor space is sensed and temperature is controlled thereby have been proposed.

Conventional air conditioners are classified into two types, as detailed below, according to human body sensing methods.

First, a triangular method is a method of calculating the position of an object by measuring distances from predefined reference points. As the triangular method, there are an active badge system using infrared light, an active bat system using ultrasonic waves, and an easy living system using a vision system.

Next, a proximity method is a method of determining a position using proximity to a known reference point. As the proximity method, there is a smart floor system using a pressure sensor and an automatic ID system using RFID.

Further, human body sensing devices may be divided into a terminal based method, such as an active bat system, and a non-terminal based method using a vision sensor or a pressure sensor according to whether or not a resident possesses a terminal.

In case of the terminal based method using infrared light or ultrasonic waves, the position of a resident is not searched but the position of a terminal possessed by a resident is searched. Thereby, only if a resident possesses a terminal at all time in an indoor space, the position of the terminal of the resident may be recognized.

On the other hand, an easy living system using a vision system may cause privacy violation in home, and a smart floor system using a pressure sensor may have poor scalability and a difficulty in management.

As human body sensors which have been used or developed now in security, home electronics, and lighting, passive infrared sensors (PIR), which directly generate electrical signals in response to external heat sources, are employed. These conventional human body sensors are motion sensors which may sense a human body present within a sensing area only if the human body moves, and such a PIR sensor senses infrared light of 8~12 μm emitted from a human body when the human body moves. Then, the PIR sensor converts received light energy, changed when the PIR sensor senses infrared light, into an electrical signal and may thus recognize the human body moving within a sensing range.

SUMMARY

An innovative aspect of the subject matter described in this specification may be embodied in an air conditioner that includes an outdoor unit; an indoor unit located in a building and configured to distribute cool air to a space within the building; and an antenna unit configured to sense (i) movement of human bodies within the space or (ii) presence of human bodies located in the space and determine a number of human bodies based on the sensed presence, where the antenna unit includes a housing and a plurality of antenna arrays located on an outer surface of the housing.

These and other embodiments can each optionally include one or more of the following features. The housing is detachably located on the indoor unit or a ceiling of the space. The indoor unit includes an indoor unit housing that defines an external appearance of the indoor unit. The indoor unit housing includes (i) a front panel that defines a frame part of a lower surface of the indoor unit, (ii) a cabinet located on the upper surface of the front panel, (iii) an indoor fan, and (iv) an indoor heat exchanger. The housing is detachably located on the front panel. The housing is configured to rotate and has a circular cross section.

The housing is a conical shape or a hemispherical shape. The housing is located in the space and the circular cross section of the housing decreases from a surface where the housing is located in a direction perpendicular the surface. The plurality of antenna arrays is located on the housing in the circumferential direction of the housing and is configured to sense movement of human bodies or the presence of human bodies in the space. Each of the antenna arrays comprises a plurality of antenna patterns arranged in a line. Each of the plurality of antenna arrays is separated a respective distance along the outer surface of the housing. Each distance decreases in a downward direction perpendicular a surface where the housing is located.

The space is divided into a plurality of detection zones, wherein a number of the plurality of antenna arrays corresponds to a number of the plurality of detection zones. The antenna unit further includes (i) a transceiver configured to receive radio signals from the plurality of antenna arrays or transmit radio signals to the plurality of antenna arrays and (ii) a switch that is configured to connect the plurality of antenna arrays to the transceiver. The switch sequentially connects the plurality of antenna arrays to the transceiver and sequentially disconnects the plurality of antenna arrays from the transceiver in a designated direction. The antenna array is an IR-UWB antenna array.

Another innovative aspect of the subject matter described in this specification may be embodied in an air conditioner that includes an outdoor unit; an indoor unit located in a building and configured to distribute cool air to a space within the building; and an antenna unit located in the space, where the antenna unit includes (i) a housing, (ii) a plurality of antenna arrays located around a circumference of the housing and configured to sense (i) movement of human bodies within the space or (ii) presence of human bodies in space and determine a number of human bodies based on the sensed presence.

These and other embodiments can each optionally include one or more of the following features. The space is divided into a plurality of detection zones, wherein a number of the plurality of antenna arrays corresponds to a number of the plurality of detection zones. The housing is detachably located on the indoor unit or a ceiling of the space.

Another innovative aspect of the subject matter described in this specification may be embodied in an air conditioner that includes an outdoor unit; an indoor unit located in a building and configured to distribute cool air to a space within the building; and an antenna unit located in the space, where the antenna unit includes a housing; a plurality of antenna arrays configured to sense (i) movement of human bodies within the space or (ii) presence of human bodies in the space; a processor configured to determine a number of human bodies based on the sensed presence; a transceiver configured to receive radio signals from the plurality of antenna arrays or transmit radio signals to the plurality of antenna array; and a switch configured to connect the plurality of antenna arrays to the transceiver, where the switch sequentially connects the plurality of antenna arrays to the transceiver and sequentially disconnects the plurality of antenna arrays from the transceiver in a designated direction.

These and other embodiments can each optionally include one or more of the following features. The transceiver and the switch are located on the housing of the antenna unit. The transceiver and the switch are located on a printed circuit board (PCB) and the switch is an RF switching element located on the PCB.

DETAILED DESCRIPTION

Figure 1:
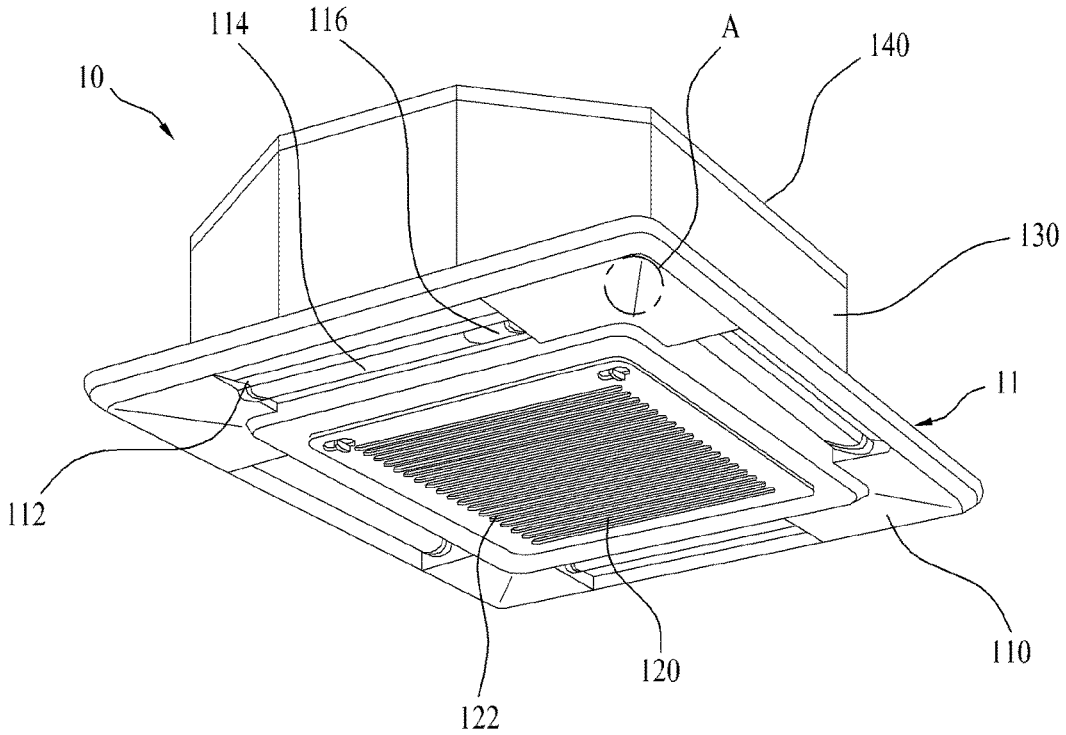
FIG. 1 is a perspective view illustrating an example indoor unit of an air conditioner.
Figure 2:
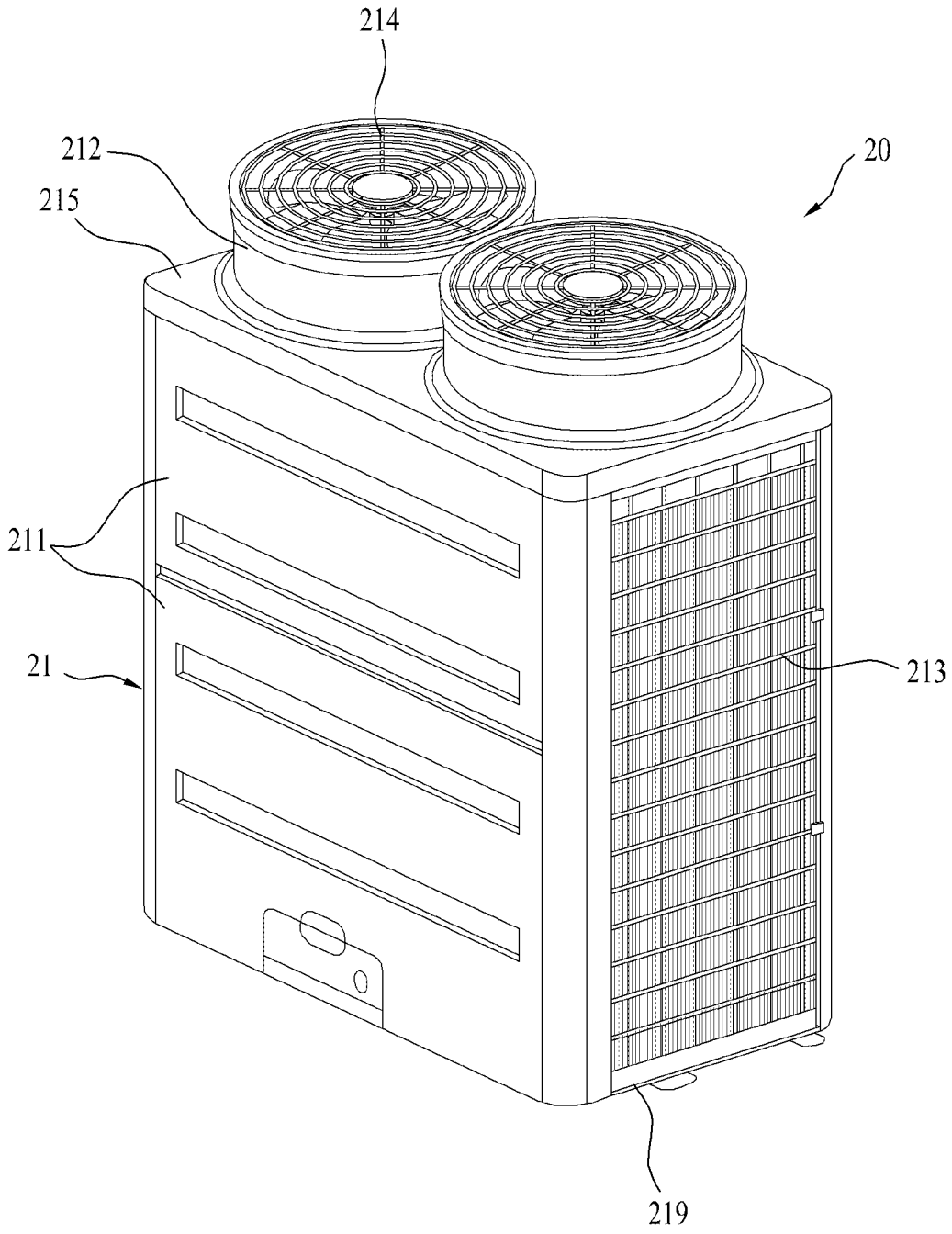
FIG. 2 is a perspective view illustrating an example outdoor unit of an air conditioner.
Figure 3:
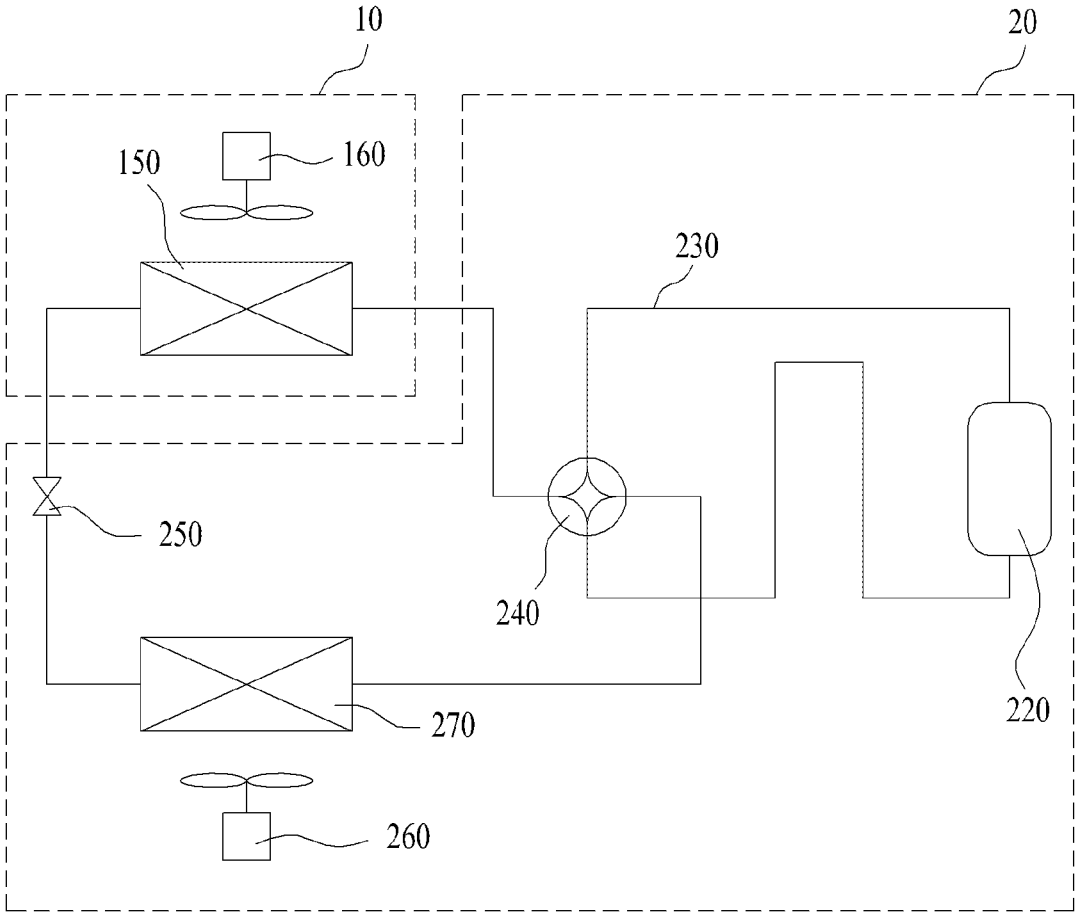
FIG. 3 is a block diagram schematically illustrating a configuration of an example indoor unit and an example outdoor unit.

FIG. 1 is a perspective view illustrating an example indoor unit 10 of an air conditioner. FIG. 2 is a perspective view illustrating an example outdoor unit 20 of the air conditioner. FIG. 3 is a block diagram schematically illustrating a configuration of an example indoor unit 10 and an example outdoor unit 20.

The air conditioner may include an indoor unit 10 and an outdoor unit 20. Further, the air conditioner may include a four-way valve 240.

With reference to FIGS. 1 and 3, the indoor unit 10 may include an indoor heat exchanger 150 and an indoor fan 160. The indoor unit 10 further includes an indoor unit housing 11, and the indoor heat exchanger 150 and the indoor fan 160 are accommodated in the indoor unit housing 11.

The indoor heat exchanger 150 may function as an evaporator during cooling operation and function as a condenser during heating operation. The indoor heat exchanger 150 is connected to an outdoor heat exchanger 270 of the outdoor unit 20 through a circulation path 230 along which a refrigerant circulates.

In some implementations, the indoor unit 10 may be installed such that the upper part of the indoor unit 10 is inserted into a ceiling and the lower surface of the indoor unit 10 is exposed downward from the ceiling to the outside.

With reference to FIG. 1, the indoor unit housing 11 forming the external appearance of the indoor unit 10 may include a front panel 110 forming the frame part of the lower surface of the indoor unit 10. Further, the indoor unit housing 11 may include a suction grill 120 installed at the center of the front panel 110 so as to cause indoor air to be introduced into the indoor unit 10. Further, the indoor unit housing 11 may include a cabinet 130 forming the upper portion of the indoor unit 10 and accommodating a plurality of components therein. The cabinet 130 is provided on the upper surface of the front panel 110. Further, the indoor unit housing 11 may include a base 140 closing the upper surface of the cabinet 130 and causing the indoor unit 10 to be mounted within a ceiling.

A tetragonal hole is formed through the center of the front panel 110, the suction grill 120 is mounted within the hole, and rectangular discharge holes 112 are formed at the edge of the front panel 110. The discharge holes 112 discharges air, heat-exchanged in the indoor unit 10, again to an indoor space. The discharge holes 112 having the same shape may be formed through the edge of the front panel 110.

A louver 114 forcibly determining the flow direction of air discharged to the indoor space through the discharge hole 112 is formed at the discharge hole 112. The louver 114 has a rectangular plate shape corresponding to the shape and size of the discharge hole 112, is connected to a motor (not shown) generating rotary force, and is rotated, thus forcibly determining the flow direction of air. Therefore, air discharged to the indoor space through the discharge hole 112 is blown to a region distant from the discharge hole 112 and thus, the indoor unit 10 maximizes air conditioning effects.

The suction grill 120 having an approximately tetragonal plate shape is mounted at the center of the front panel 110. As described above, the suction grill 120 sucks indoor air to the inside of the indoor unit 10. Therefore, a plurality of suction holes 122 extended in the horizontal direction is vertically formed through the center of the suction grill 120. Here, reference numeral 116 represents a refrigerant sensor detecting leaked refrigerant.

The indoor heat exchanger 150 and the indoor fan 160 may be installed within the cabinet 130.

A plurality of indoor units 10 may be provided and the plural indoor units 10 may be respectively disposed within plural indoor spaces. The outdoor unit 20 may be disposed at an outdoor space.

With reference to FIG. 3, the outdoor unit 20 may include a compressor 220, an outdoor heat exchanger 270, an outdoor expansion valve 250, and an outdoor fan 260. Further, the outdoor unit 20 may include an outdoor unit housing 21 (with reference to FIG. 2) and the compressor 220, the outdoor heat exchanger 270, the outdoor expansion valve 250, and the outdoor fan 260 are accommodated within the outdoor unit housing 21. The outdoor heat exchanger 270 may function as a condenser during cooling operation and function as an evaporator during heating operation.

The compressor 220 compresses introduced refrigerant in a low-temperature and low-pressure state into refrigerant in a high-temperature and high-pressure state. Various structures may be applied to the compressor 220, and an inverter-type compressor may be employed as the compressor 220.

With reference to FIG. 2, the outdoor unit housing 21 may include a front panel 211 closing the indoor space of the outdoor unit 20 at the front and forming the front surface of the outdoor unit housing 21. Further, the outdoor unit housing 21 may include side grills 213 guiding introduction of outdoor air at the left and right sides of the outdoor unit housing 21. Further, the outdoor unit housing 21 may include a rear grill guiding introduction of external air from the rear to the inside of the outdoor unit housing 21. Further, the outdoor unit housing 21 may include a base 219 supporting a plurality of components. Further, the outdoor unit housing 21 may include a upper panel 215 guiding discharge of air, heat-exchanged in the outdoor unit 20, in the upward direction.

A pair of ventilation holes 214 may be formed at the center of the upper panel 215 so as to discharge air, heat-exchanged in the outdoor unit 20, to the outside of the outdoor unit 20.

A shroud 212 having a cylindrical shape is mounted at the border of the upper surface of the ventilation hole 214, and the number of the shrouds 212 corresponds to the number of the ventilation holes 214. The shroud 212 guides the flow direction of air discharged to the outside of the outdoor unit 20 through the ventilation hole 214. An outdoor fan 260 may be provided in the shroud 212.

The four-way valve 240 adjusts the circulation path 230 of the refrigerant discharged from the compressor 220. That is, the four-way valve 240 is a flow path change valve for conversion between cooling and heating, and guides the refrigerant compressed by the compressor 220 to the outdoor heat exchanger 270 during cooling operation and guides the refrigerant compressed by the compressor 220 to the indoor heat exchanger 150 during heating operation.

Further, the air conditioner may include a controller controlling at least one of temperature, air direction, air volume, and air velocity according to the number of human bodies or movement of human bodies sensed by a human body sensing antenna unit 300, which will be described later.

Figure 4:
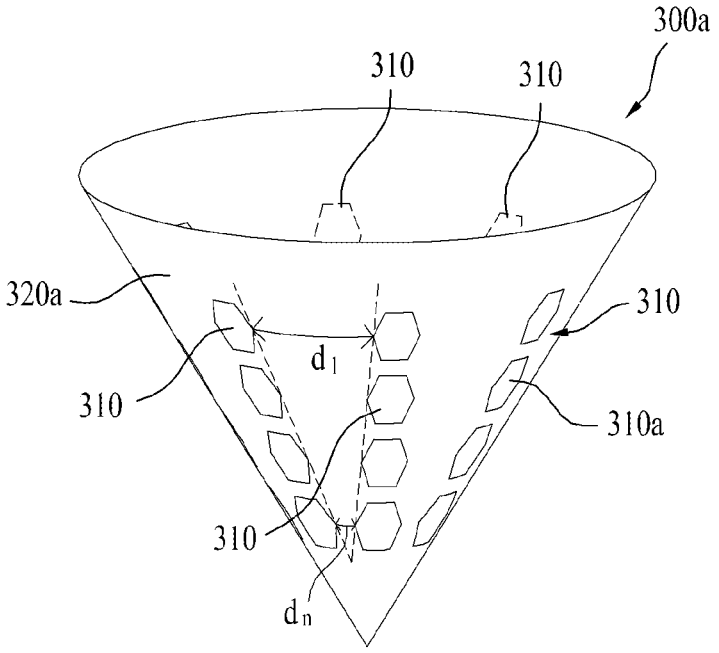
FIGS. 4-5 are perspective views illustrating external appearances of example antenna units.
Figure 5:
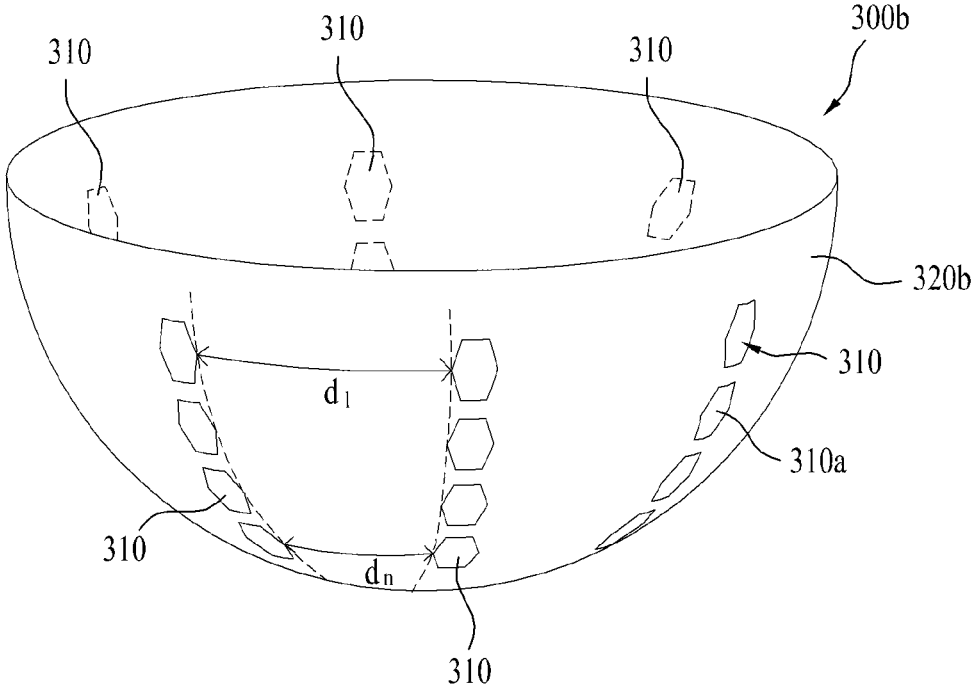
Figure 6:
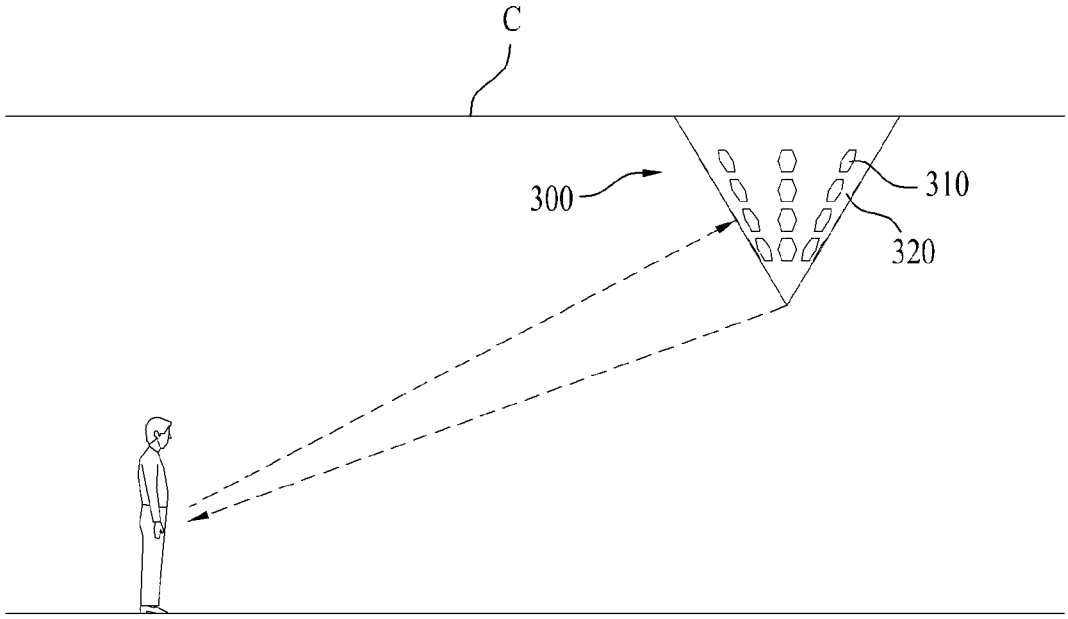
FIG. 6 is a view illustrating an example antenna unit installed on a ceiling.
Figure 7:
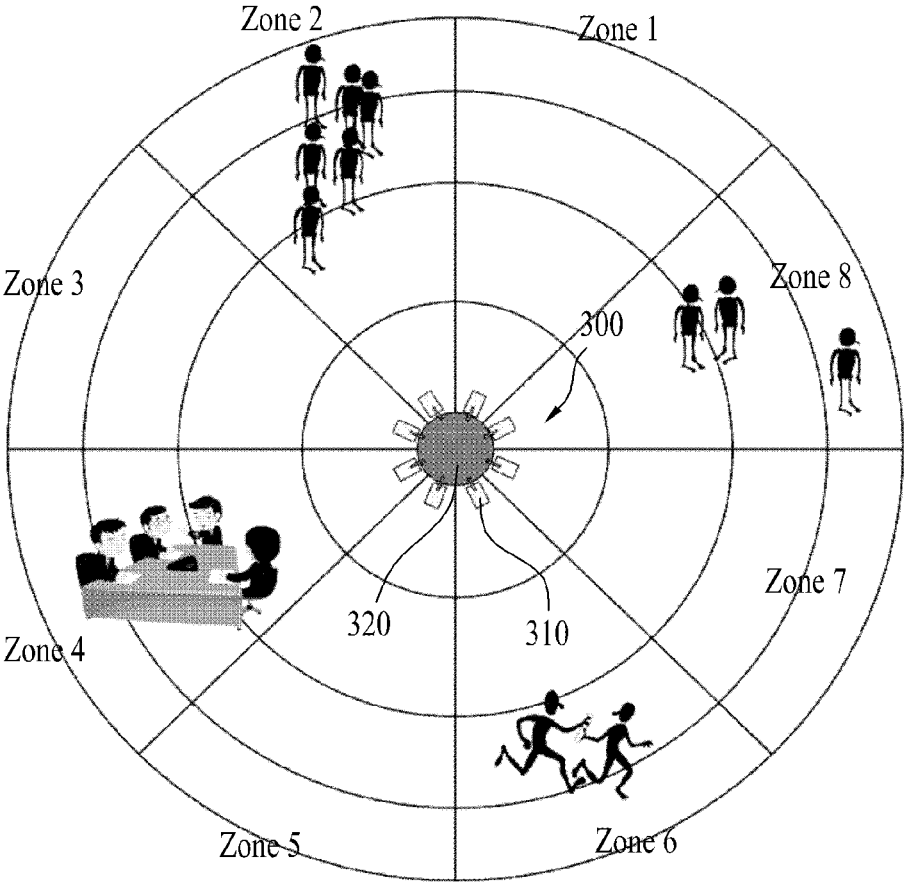
FIG. 7 is a view schematically illustrating an example indoor unit divided into a plurality of zones and an example antenna unit.
Figure 8:
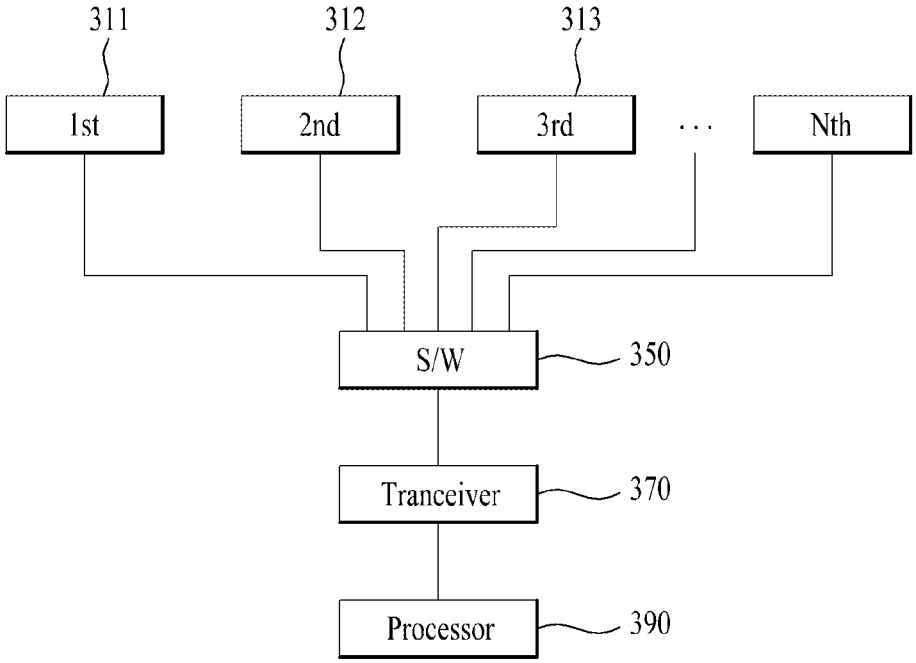
FIG. 8 is a block diagram schematically illustrating a configuration of an example antenna unit.

FIGS. 4-5 are perspective views illustrating external appearances of example antenna units 300*a* and 300*b*. FIG. 6 is a view illustrating an example antenna unit 300 installed on a ceiling. FIG. 7 is a view schematically illustrating an example indoor unit 10 divided into a plurality of zones and an example antenna unit 300. FIG. 8 is a block diagram schematically illustrating a configuration of an example antenna unit 300.

In some implementations, the air conditioner may include the human body sensing antenna unit 300 sensing movement of human bodies or the number of human bodies located within an air conditioning space in which the indoor unit 10 is installed.

With reference to FIGS. 4 and 8, the antenna unit 300*a* may include a plurality of antenna arrays 310. Further, the antenna unit 300*a* may include a housing 320 provided with the outer surface on which the plurality of antenna arrays 310 is installed. Further, the antenna unit 300*a* may include a transceiver 370 transmitting a radio signal to the antenna arrays 310 and receiving radio signals from the antenna arrays 310. Further, the antenna unit 300*a* may include a switch 350 selectively connecting the plurality of antenna arrays 310 and the transceiver 370. Further, the antenna unit 300*a* may include a signal processor 390 receiving reflected radio signals received by the antenna arrays 310 from the transceiver 370, processing the reflected radio signals, and thus judging whether or not human bodies move within the indoor space and the number of human bodies located in the indoor space.

The transceiver 370 may be replaced with a transmitter transmitting radio signals and a receiver receiving radio signals.

The antenna unit 300*a* may be an ultra wide band (UWB) antenna unit. More particularly, the antenna unit 310 may be an impulse radio UWB (IR-UWB) antenna unit.

IR-UWB is a low-velocity position-based network technology using a UWB pulse and provides functions of distance estimation and position estimation forming the basis of Ubiquitous Environment. IR-UWB provides an error range of one meter or less in distance estimation. Based on wireless communication, IR-UWB uses an ultra wide band of 3.1 GHz~10.6 GHz as a frequency band and assures a system dynamic range within thirty meters.

The frequency band used by IR-UWB may be divided into three bands, i.e., a sub-GHz band, a low-band, and a high-band. Sixteen channels are assigned to the three bands. The sixteen channels may be divided into channels including channels 0, 3 and 9, and other channels. In some implementations, one channel is implemented. IR-UWB may be applied to position estimation in a stopped and/or low-velocity moving state.

Although the human body sensing antenna unit 300*a* is installed in an indoor space in which the indoor unit 10 is installed, the position of the human body sensing antenna unit 300*a* is not limited thereto. However, in order to cover the entirety of the indoor space without a dead zone, the antenna unit 30 may be installed on the ceiling C of the indoor space in which the indoor unit 10 is installed, i.e., an air conditioning space (with reference to FIG. 6).

The antenna unit 300 may be installed on the ceiling, i.e., the ceiling surface, of the indoor space or on the above-described indoor unit 10. Here, the antenna unit 300 may be installed on the indoor unit housing 11 of the indoor unit 10 and, in some implementations, installed on the front panel 110 of the indoor unit housing 11.

With reference to FIG. 1, the antenna unit 300 may be installed at the edge of the front panel 110. If the front panel 110 has a rectangular shape, the antenna unit 300 may be installed at a corner A of the front panel 110. In some implementations, the antenna unit 300 may be installed at the corner A located between neighboring discharge holes 112.

Further, the antenna unit 300 may be provided so as to be detachably installed on the ceiling or the indoor unit 10. Therefore, the antenna unit 300 may be may be installed selectively at a position of the indoor space in which the indoor unit 10 is installed, where there may not be an obstacle and the antenna unit 300 effectively covers the entirety of the indoor space.

With reference to FIGS. 4 and 6, the housing 320*a* has a designated space formed therein and the antenna arrays 310 are installed on the outer surface of the housing 320*a*. Although the shape of the housing 320*a* may be variously modified, the housing 320*a* may be a rotating body having a circular horizontal section. In some implementations, the housing 320*a* may have a conical shape.

If the housing 320*a* has a conical shape, the conical housing 320*a* is installed such that the apex of the conical housing 320*a* faces downward. That is, the conical housing 320*a* is installed such that the apex or generating line of the conical housing 320*a* faces the indoor space downward. In more detail, the housing 320*a* is installed such that the horizontal sectional area of the housing 320*a* decreases in a downward direction perpendicular to the ceiling surface. Here, the lower surface of the conical housing 320*a* is closely adhered to the ceiling surface C. As described above, at least one of the transceiver 370 and the switch 350 is installed within the housing 320*a* and, more particularly, both the transceiver 370 and the switch 350 may be installed within the housing 320*a*. The lower surface of the housing 320*a* may be opened so as to achieve communication between the transceiver 370 and switch 350 and the signal processor 390.

Plural antenna patterns 310*a* are arranged in a line, thus forming one antenna array 310. The antenna patterns 310*a* are attached to the outer surface of the housing 320*a*.

The plurality of antenna arrays 310 is installed along the outer surface of the housing 320*a*. Here, the plural antenna arrays 310 may be separated from each other by a designated interval on the outer surface of the housing 320*a*.

Further, the antenna arrays 310, each of which has a structure in which the plural antenna patterns 310*a* are arranged in a line, may be installed so as to face the lower surface of the housing 320*a* from the generating line of the housing 320*a* (or in the reverse direction). Therefore, the plural antenna arrays 310 are separated from each other by a designated interval in the circumferential direction of the outer surface of the housing 320*a*.

The interval between the plural antenna arrays 310 may decrease in the downward direction perpendicular to the surface C on which the housing 320*a* is installed. That is, the interval $d_n$ between the plural antenna arrays 310 decreases in a direction from the installation surface C to the lower end of the housing 320*a*.

One antenna array 310 senses movement of human bodies or the number of human bodies located within the corresponding one of zones divided from the indoor space.

Further, with reference to FIG. 5, the housing 320*b* may have a hemispherical shape. If the housing 320*b* has a hemispherical shape, plural antenna arrays 310 may be installed so as to face the lower surface of the housing 320*b* and be separated from each other by a designated interval in the circumferential direction of the outer circumferential surface of the housing 320*b*.

In some implementations, the housing 320*b* may have various other shapes, such as a sphere, a cone, a cylinder, and a polypyramid.

With reference to FIG. 7, the number of the antenna arrays 310 corresponds to the number of zones divided from the indoor space. For example, if the indoor space in which the indoor unit 10 is installed is divided into 8 zones, 8 antenna arrays 310 may be provided on the housing 320.

Radio waves emitted by the antenna arrays 310 are transmitted to the corresponding zones of the indoor space and are reflected by obstacles (human bodies or fixed objects). The reflected radio waves are received by the antenna arrays 310 sensing the corresponding zones.

With reference to FIG. 8, the transceiver 370 may function to generate a radio signal and to transmit the radio signal to the antenna array 310 or to receive radio signals from the antenna array 310. The transceiver 370 may be located within the housing 320.

The transceiver 370 transmits the radio signals received from the antenna array 310 to the signal processor 390. The signal processor 390 may sense movement of human bodies or the number of human bodies in the corresponding zones using the received radio signals. Further, the controller controls at least one of indoor temperature, air direction, air volume and air velocity according to movement of human bodies or the number of human bodies sensed by the signal processor 390.

In order to transmit the radio signal generated by the transceiver 370 to the plurality of antenna arrays 310, the antenna unit 300 includes the switch 350. The switch 350 may be located between the antenna arrays 310 and the transceiver 370.

The switch 350 selectively connects the plurality of antenna arrays 310 to the transceiver 370.

If the number of the plural antenna arrays 310 is n, the switch 350 sequentially connects the n antenna arrays 310 to the transceiver 370.

If the first antenna array 311 emits radio waves, the switch 350 connects the first antenna array 311 to the transceiver 370 and, if the second antenna array 312 emits radio waves, the switch 350 connects the second antenna array 312 to the transceiver 370. After the switch 350 sequentially connects the $n^{th}$ antenna array to the transceiver 370 in such a manner, the switch 350 connects the first antenna array 311 to the transceiver 370 again.

The n antenna arrays 310 sense movement of human bodies or the number of human bodies located in the n corresponding zones divided from the indoor space.

The switch 350 may be an RF switching element having a MEMS structure. The switch 350 in an element type may be provided on a PCB. Here, the switch 350 may be mounted on the PCB. Further, both the transceiver 370 and the switch 350 in an element type may be mounted on a PCB.

With reference to FIGS. 7 and 8, operation of the human body sensing antenna unit 300 of the air conditioner will be described.

The plural antenna arrays 310 are disposed along the outer circumferential surface of the housing 320 in the circumferential direction. Each of the plural antenna arrays 310 senses movement of human bodies or the number of human bodies located in each of zones (zone 1 to zone 8) divided from the indoor space.

The switch 350 sequentially connects the plural antenna arrays 310 to the transceiver 370 and releases connection of the plural antenna arrays 310 to the transceiver 370. Here, the switch 350 connects the adjacent antenna arrays 310 installed on the housing 320 to the transceiver 370 in a designated direction.

After the switch 350 releases connection of a specific antenna array 310 to the transceiver 370, the switch 350 connects another antenna array 310, sensing a zone adjacent to the zone sensed by the specific antenna array 310, to the transceiver 370. That is, the switch 350 connects the antenna array 310 sensing the zone 1 to the transceiver 370 and then connects the antenna array 310 sensing the zone 2 adjacent to the zone 1 to the transceiver 370. Here, the switch 350 may connect the antenna arrays 310 to the transceiver 370 in the counterclockwise direction or the clockwise direction.

In more detail, if the first antenna array 311 senses movement of human bodies or the number of human bodies within a corresponding zone, the switch 350 connects the first antenna array 311 to the transceiver 370.

The transceiver 370 transmits a radio signal, which will be emitted through the antenna arrays 310, to the first antenna array 311.

Then, the first antenna array 311 emits radio waves to the zone 1. The radio waves emitted by the first antenna array 311 are reflected by an obstacle in the zone 1 and are received again by the first antenna array 311.

The radio signal received by the first antenna array 311 is transmitted to the transceiver 370 through the switch 350.

The transceiver 370 transmits the radio signal received from the first antenna array 311 to the signal processor 390.

When the transceiver 370 transmits the radio signal to the signal processor 390, the switch 350 releases connection of the first antenna array 311 to the transceiver 370. Thereafter, the switch 350 connects the second antenna array 312 to the transceiver 370. The subsequent process is the same as the above-described process performed by the first antenna array 311 and a detailed description thereof will thus be omitted.

By repeating such a process, the switch 350 releases connection of the $n^{th}$ antenna array 310 to the transceiver 370, and then connects the first antenna array 311 to the transceiver 370 again.

Here, the first antenna array 311 and the second antenna array 312 are located adjacent to each other. That is, the first antenna array 311 and the second antenna array 312 are antenna arrays respectively sensing two adjacent zones divided from the indoor space.

In some implementations, the described air conditioner may sense movement of human bodies or the number of human bodies located in an indoor space instead of a conventional air conditioner sensing human bodies through an IR-UWB antenna using infrared light.

The human body sensing antenna unit of the air conditioner may be detachably installed on the ceiling or the indoor unit and thus, the installation position of the human body sensing antenna unit may be changed according to sizes or shapes of an indoor space.

The indoor space in which the air conditioner is installed may have various shapes according to building structures. If the human body sensing antenna unit is fixed to the indoor unit, the antenna unit may not be disposed at a proper position so as to correspond to various indoor spaces. In some implementations, the antenna unit is detachably provided and may thus be installed at a position to cover the corresponding indoor space.

Further, in the conventional air conditioner, if human bodies are sensed using an antenna, one antenna does not sense all directions of an indoor space and thus needs to be rotated by a motor. In some implementations, a switch sequentially connecting a plurality of antenna arrays to a transceiver is provided, a motor to rotate the antenna unit may not required, and thus motor manufacturing costs may be reduced and air conditioner manufacturing costs may be reduced.

In some implementations, an air conditioner having a human body sensing unit may sense movement of human bodies or the number of human bodies located within an indoor space.

In some implementations, the human body sensing antenna unit may be detachably installed on a ceiling or an indoor unit and thus, the installation position of the human body sensing antenna unit may be changed according to sizes or shapes of the indoor unit.

In some implementations, the air conditioner is provided with a switch sequentially connecting a plurality of antenna arrays to a transceiver and may not require a motor to rotate the antenna unit, and may thus reduce motor manufacturing costs.

What is claimed is:

1. An air conditioner comprising:

an outdoor unit;

an indoor unit located in a building and configured to distribute cool air to a space within the building; and an antenna unit configured to sense (i) movement of human bodies within the space or (ii) presence of human bodies located in the space and determine a number of human bodies based on the sensed presence, wherein the antenna unit includes a housing, a plurality of antenna arrays located on an outer surface of the housing, a transceiver configured to receive radio signals from the plurality of antenna arrays or transmit radio signals to the plurality of antenna arrays, and a radio frequency (RF) switching element configured to selectively connect the plurality of antenna arrays to the transceiver, wherein the RF switching element is configured to sequentially connect the plurality of antenna arrays to the transceiver and disconnect the plurality of antenna arrays from the transceiver in a designated direction, wherein the housing is located in the space and has a conical shape having sequential circular cross sections that decrease in area in a downward direction perpendicular to a surface on which the housing is located, and wherein the plurality of antenna arrays are located on the outer surface of the housing and are configured to sense movement of human bodies or a presence of human bodies in the space.

2. The air conditioner of claim 1, wherein the housing is detachably located on the indoor unit or a ceiling of the space.

3. The air conditioner of claim 2, wherein:

the indoor unit includes an indoor unit housing that defines an external appearance of the indoor unit;

the indoor unit housing includes (i) a front panel that defines a frame part of a lower surface of the indoor unit, (ii) a cabinet located on the upper surface of the front panel, (iii) an indoor fan, and (iv) an indoor heat exchanger; and the housing is detachably located on the front panel.

4. The air conditioner of claim 1, wherein the housing is configured to rotate and has a circular cross section that is perpendicular to the surface on which the housing is located.

5. The air conditioner of claim 1, wherein each of the antenna arrays comprises a plurality of antenna patterns arranged in a line.

6. The air conditioner of claim 1, wherein each of the plurality of antenna arrays is separated a respective distance along the outer surface of the housing.

7. The air conditioner of claim 6, wherein each distance between antenna arrays decreases in the downward direction perpendicular to the surface on which the housing is located.

8. The air conditioner of claim 1, wherein the space is divided into a plurality of detection zones, wherein a number of the plurality of antenna arrays corresponds to a number of the plurality of detection zones.

9. The air conditioner of claim 8, wherein the antenna array is an IR-UWB antenna array.

10. An air conditioner comprising:

an outdoor unit;

an indoor unit located in a building and configured to distribute cool air to a space within the building; and an antenna unit located in the space, wherein the antenna unit includes:

a housing located in the space;

a plurality of antenna arrays configured to sense (i) movement of human bodies within the space or (ii) presence of human bodies in the space;

a processor configured to determine a number of human bodies based on the sensed presence;

a transceiver configured to receive radio signals from the plurality of antenna arrays or transmit radio signals to the plurality of antenna array; and a radio frequency (RF) switching element configured to connect the plurality of antenna arrays to the transceiver, wherein the RF switching element sequentially connects the plurality of antenna arrays to the transceiver and sequentially disconnects the plurality of antenna arrays from the transceiver in a designated direction, wherein the housing has a conical shape having sequential circular cross sections that decrease in area in a downward direction perpendicular to a surface on which the housing is located, and wherein the plurality of antenna arrays are located on the outer surface of the housing and are configured to sense movement of human bodies or a presence of human bodies in the space.

11. The air conditioner of claim 10, wherein the transceiver and the RF switching element are located on the housing of the antenna unit.

12. The air conditioner of claim 11, wherein the transceiver and the RF switching element are located on a printed circuit board (PCB).

* * * * *